US007172537B2

(12) United States Patent
Eisa

(10) Patent No.: US 7,172,537 B2
(45) Date of Patent: Feb. 6, 2007

(54) GYMNASTIC MACHINE AND METHODS FOR USING IT, FOR TRAINING AND/OR REHABILITATION OF THE MUSCLES AND JOINTS OF THE HUMAN BODY

(76) Inventor: Mohamed Bahaa El Din Eisa, Via Carlo Bini 14-50134, Florence (IT)

( * ) Notice: Subject to any disclaimer, the term of this patent is extended or adjusted under 35 U.S.C. 154(b) by 0 days.

(21) Appl. No.: 10/512,649

(22) PCT Filed: Apr. 24, 2003

(86) PCT No.: PCT/IT03/00259

§ 371 (c)(1),
(2), (4) Date: Oct. 25, 2004

(87) PCT Pub. No.: WO03/092822

PCT Pub. Date: Nov. 13, 2003

(65) Prior Publication Data

US 2005/0164851 A1 Jul. 28, 2005

(30) Foreign Application Priority Data

May 3, 2002 (IT) ..... FI2002A0073

(51) Int. Cl.
*A63B 21/00* (2006.01)
*A63B 21/062* (2006.01)

(52) U.S. Cl. ..... 482/138; 482/100

(58) Field of Classification Search ..... 482/137–138, 482/97–103, 906
See application file for complete search history.

(56) References Cited

U.S. PATENT DOCUMENTS

| | | | | |
|---|---|---|---|---|
| 2,782,033 | A | 2/1957 | Ugartechea | |
| 4,627,617 | A * | 12/1986 | Gilmore et al. | 482/92 |
| 4,799,858 | A * | 1/1989 | Shin-Chin | 416/110 |
| 5,290,214 | A * | 3/1994 | Chen | 482/137 |
| 5,417,633 | A * | 5/1995 | Habing | 482/97 |
| 5,779,601 | A * | 7/1998 | Ish, III | 482/100 |
| 5,810,379 | A | 9/1998 | Shusterman | |
| 2002/0004439 | A1 | 1/2002 | Galbraith et al. | |

FOREIGN PATENT DOCUMENTS

| | | |
|---|---|---|
| DE | 41 07 065 | 9/1992 |
| EP | 1 161 968 | 12/2001 |
| FR | 2619017 A1 * | 2/1989 |

* cited by examiner

*Primary Examiner*—Jerome Donnelly
*Assistant Examiner*—Fenn C. Mathew
(74) *Attorney, Agent, or Firm*—McGlew & Tuttle, PC

(57) ABSTRACT

The machine comprises a frame (1) to which means are attached that can be actuated by the limbs to overcome a force generated by resistance components by performing one or more exercises. The machine comprises two work-stations having similar and similarly arranged actuating means (15, 20, 21A, 21B, 23, 123), all connected to the same resistance component (13; 113), so as to allow said persons, working together, to combine their respective efforts as they exercise.

10 Claims, 6 Drawing Sheets

GYMNASTIC MACHINE AND METHODS FOR USING IT, FOR TRAINING AND/OR REHABILITATION OF THE MUSCLES AND JOINTS OF THE HUMAN BODY

The present invention relates to a gymnastic machine for training and/or rehabilitation of the muscles and joints of the human body, comprising a frame to which means are attached that can be actuated by the limbs to overcome a force generated by resistance components-by performing one or more exercises.

There are already in the prior art a variety of different machines of this type offering a wide range of exercises for training the human body. However, the known machines are designed for individual training or rehabilitation exercises in which each person trains on their own, following a program of exercises, the type, number and intensity of which may be prescribed by an instructor. Under such conditions an instructor cannot have a precise, direct idea of how suitable the prescribed exercise actually is for the person for whom it was set, or of how the person is actually carrying it out. Furthermore, training and rehabilitation require a constant high degree of motivation from the person, which often quickly flags in the face of difficulties or the boredom of a repetitive exercise, without a direct perception of the slow but steady progress achievable with a well-executed training program.

The object of the present invention is to overcome these difficulties by means of a machine that comprises at least two workstations, each for one person, and similar and similarly arranged actuating means belonging to said workstations, all connected to the same resistance component, so as to allow said persons, working together, to combine their respective efforts as they exercise. In this way several people can work together, the groupwork giving them the extra motivation of competing with and observing each other, thus helping each one to combat the tedium typical of training. Another possibility is for a pupil to exercise together with the instructor, allowing the instructor to vary the effort in a controlled manner by cooperating with the pupil from another workstation or, by means of an auxiliary handlebar unit as will be described later, opposing the movements of the pupil, this giving a direct feel for what the pupil's limits and progress are, and allowing the instructor to put the pupil through passive stretching exercises.

Said resistance component may be a weight, a spring or an actuator of e.g. fluid, electric, electromagnetic or other type, and may be adjustable to vary the resistance force.

In a preferred embodiment, said frame has a vertical axis of symmetry about which at least two workstations are arranged, each comprising a bench and means that can be actuated for exercises to be carried out by the arms and legs. The resistance component shared by the various stations may be arranged approximately coaxially with said axis of symmetry.

The invention also comprises the methods of training and physical rehabilitation that use a machine according to the invention, particularly for group exercises using a shared resistance component and for the training of a pupil by an instructor working with or opposing the pupil and varying the effort in a controlled manner whether by movement or by being stationary.

Other aspects of the present invention are shown in the following description and in the appended claims.

A clearer understanding of the invention will be gained from the description and accompanying drawing, the latter showing a non-restrictive example of the invention. In the drawing.

Figure 1:
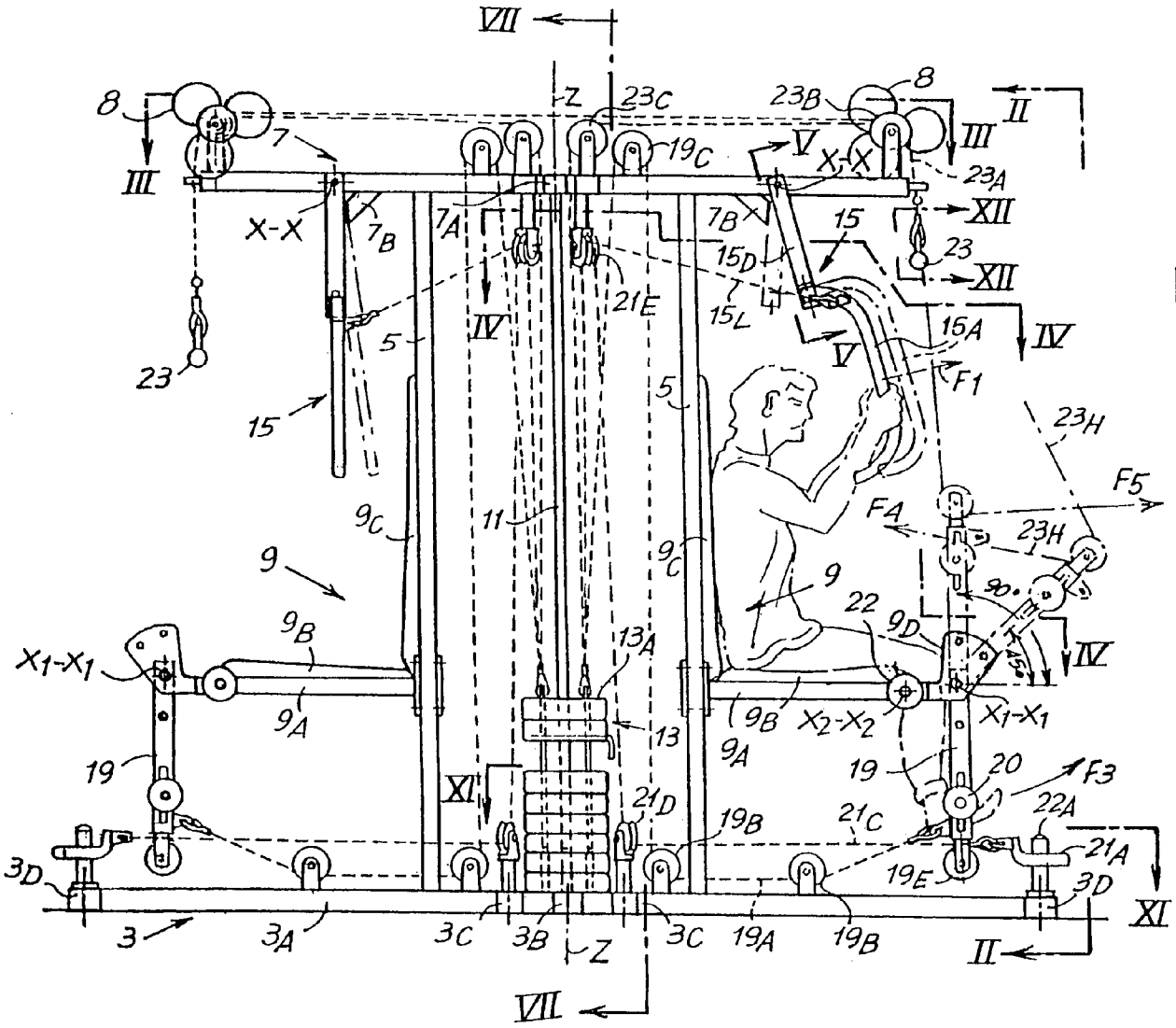
FIG. 1 is a side view of a machine according to the present invention.
Figure 3:
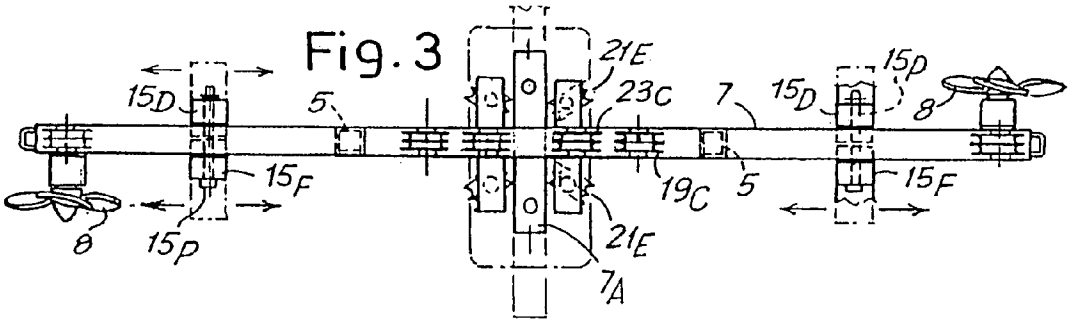
FIG. 3 is a partial top view marked III—III in FIG. 1.
Figure 10:
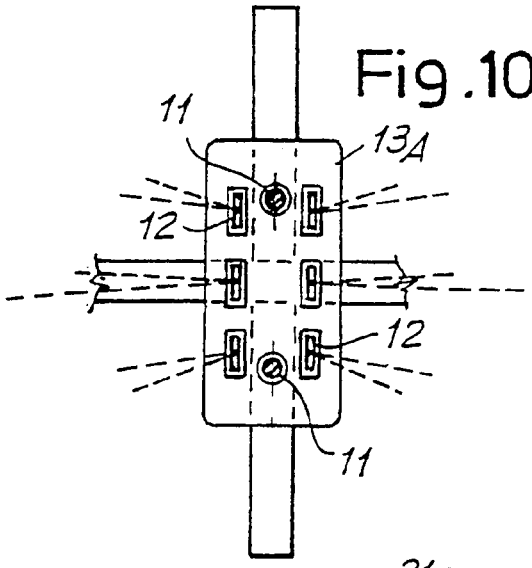
FIG. 10 is a plan view marked X—X in FIG. 8.
Figure 11:
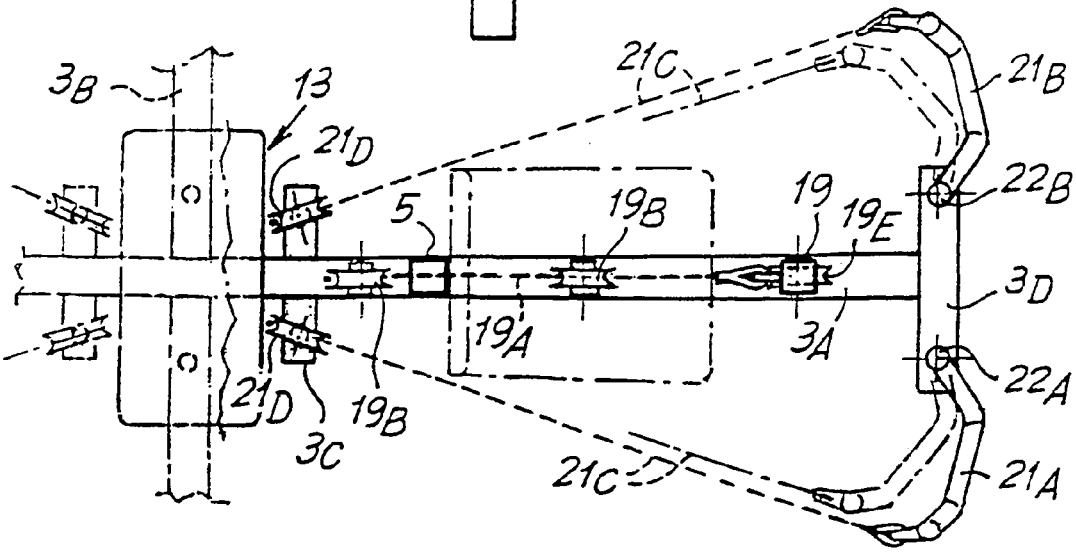
FIG. 11 is a partial plan view marked XI—XI in FIG. 1.
Figure 14:
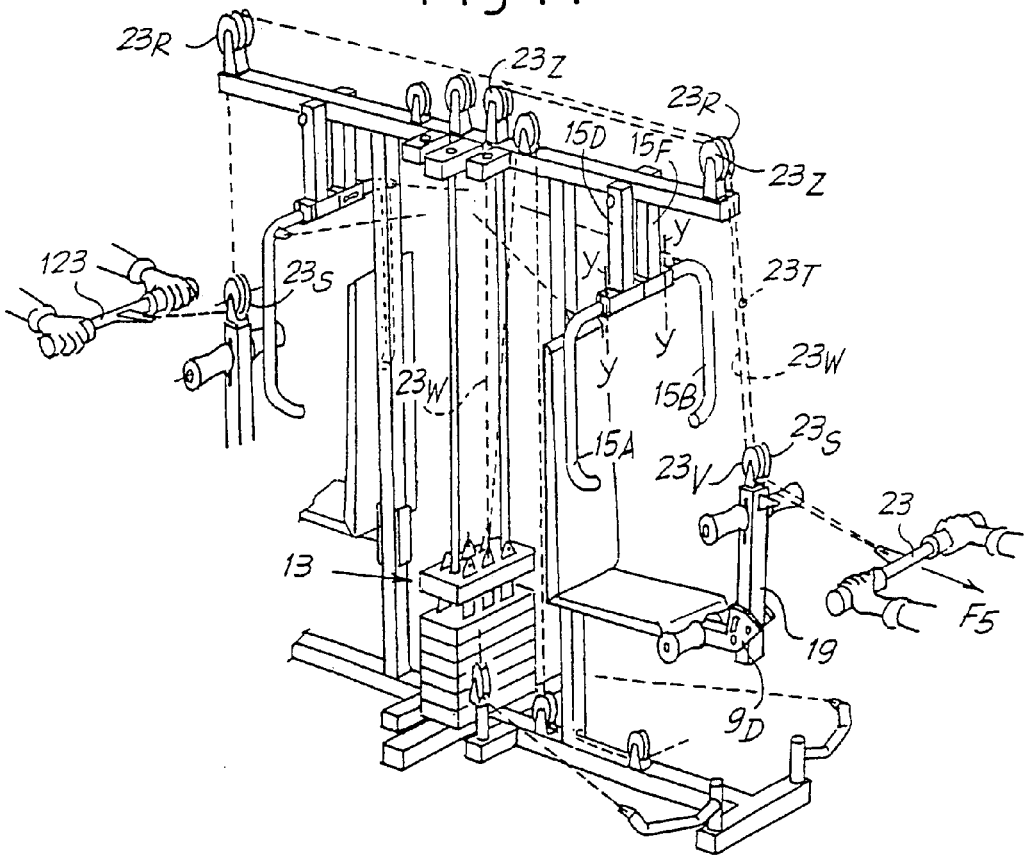
Figure 15:
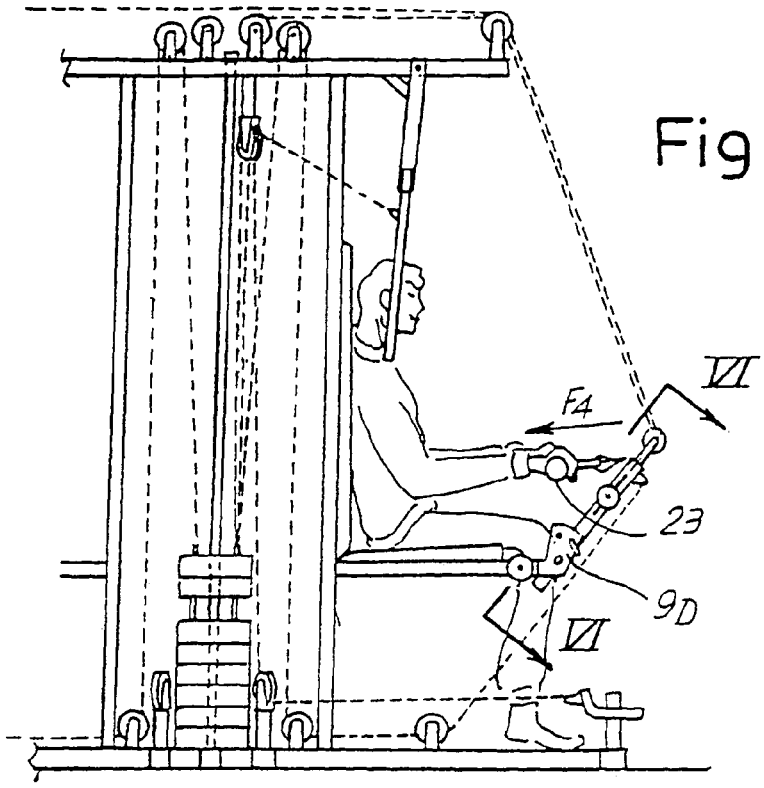
Figure 16:
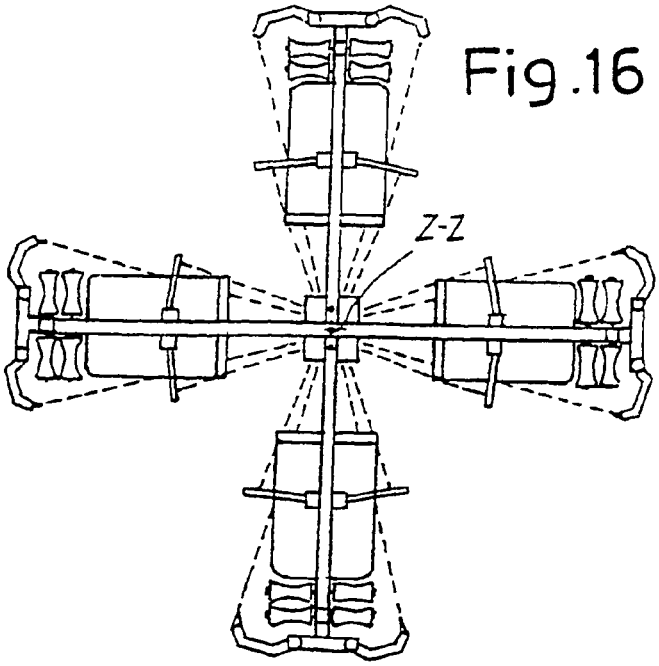
Figure 17:
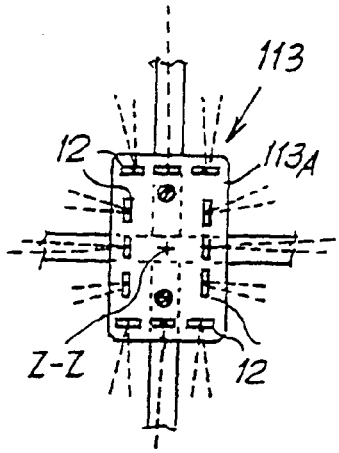

FIGS. 14 and 15 show a partial perspective view and a side view, respectively, of the machine of FIG. 1 in two different configurations of use; and FIGS. 16 and 17 are plan views similar to FIGS. 11 and 10, respectively, for another embodiment of the invention.

In a first embodiment, the machine disclosed is suitable for training or rehabilitation of two people simultaneously, or of a pupil working with a trainer.

The machine comprises a drawn steel frame 1 (FIGS. 1, 2, 3 and 7) extending largely in a vertical plane parallel to the plane of the drawing of FIG. 1, and is symmetrical about a vertical axis Z—Z. The frame comprises a cross-shaped base 3 consisting of a bar 3A with relatively short transverse pieces 3B, 3C, 3D extending out on either side of the bar 3A and fixed to it. Fixed to the base 3 are a pair of vertical uprights 5 arranged symmetrically about the axis Z—Z: these uprights are connected at the top to a longitudinal bar 7 projecting out on either side beyond the uprights 5. Fixed to the center of the top bar 7 is a short transverse piece 7A projecting to both sides. In addition a bar 9A is attached to each upright 5 like a bracket with a sitting surface 9B for a bench 9 on it, while a backrest 9C is also mounted on the upright. Two seated workstations are thus defined back to back.

The following description refers only to the right-hand workstation, when viewing FIG. 1, but it is to be understood that similar parts and parts with the same function are also to be found in the left-hand workstation.

Figure 8:
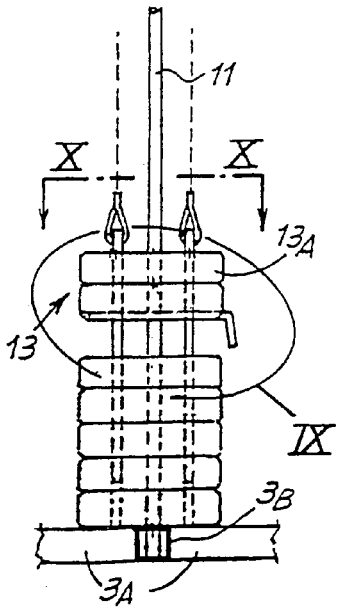
FIG. 8 is a side view marked VIII—VIII in FIG. 7.
Figure 9:
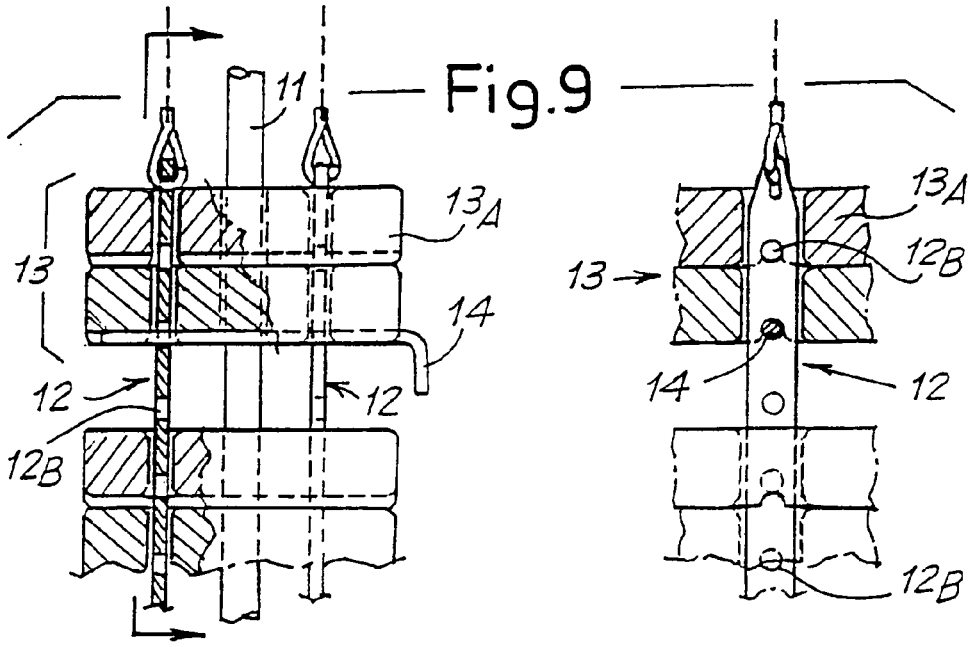
FIG. 9 shows two views of detail IX in FIG. 8, enlarged and partly sectioned.

Fixed between the base 3 and the top 7 are two vertical round bars 11 to guide a set of weights 13 that are to be lifted. The set of weights 13 to be lifted is made up of-stacked plates such as 13A (see FIGS. 8, 9 and 10) with vertical through holes for the runners 11 and with openings for flat rods 12. The rods 12 have a hole 12A at the top to attach a weight lifting cable, and holes 12B for insertion of a bar 14 at the bottom of the set of plates 13 which it is wished to lift. In this way, given a supply of stacked plates 13, it is possible to vary at will the weight to be lifted. The plates such as 13A contain two rows of three openings for the flat rods 12 to pass through, each row being situated in the half of the plates 13A nearest to the corresponding workstation, to allow for an orderly arrangement of the cables for the simultaneous lifting of the weights by the people in both workstations.

Figure 4:
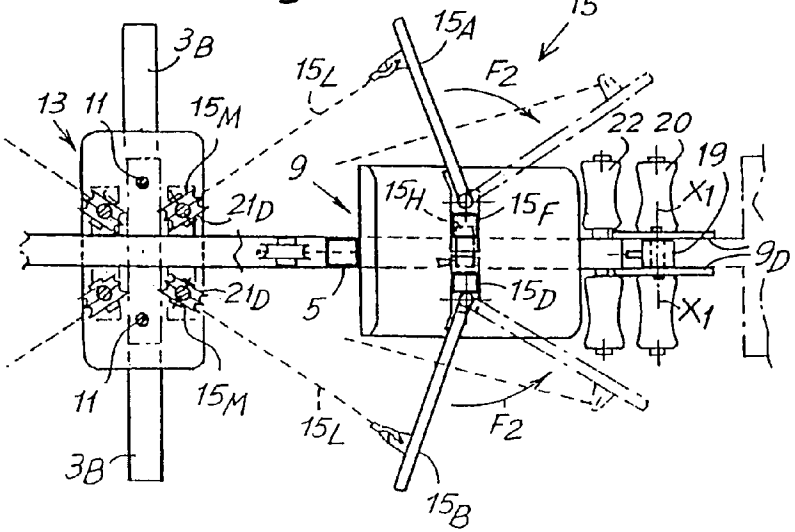
FIG. 4 is a partial plan view marked IV—IV in FIG. 1.
Figure 2:
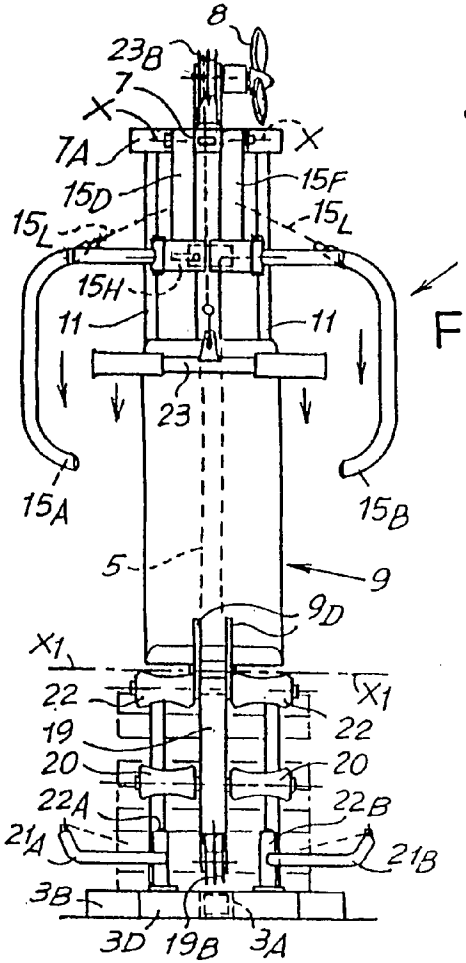
FIG. 2 is a partial end-view marked II—II in FIG. 1.
Figure 7:
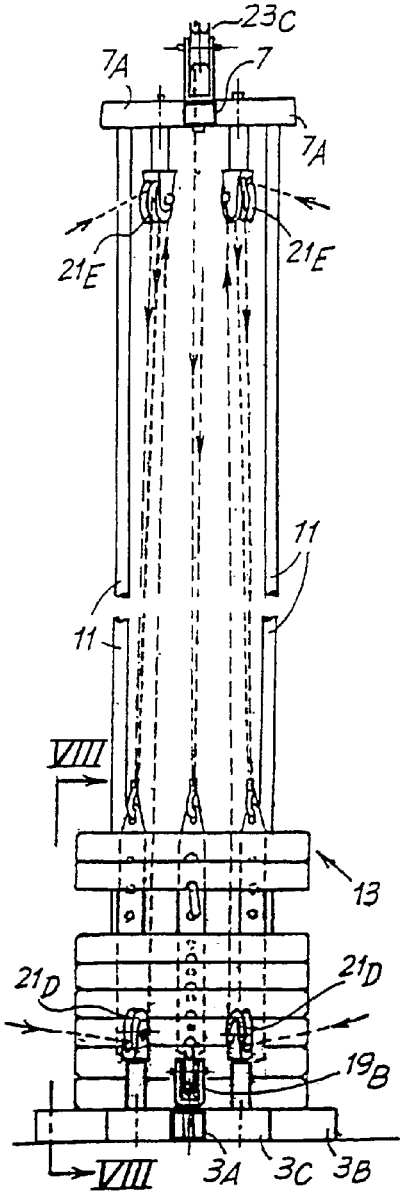
FIG. 7 is a partial side view marked VI—VII in FIG. 1.
Figure 5:
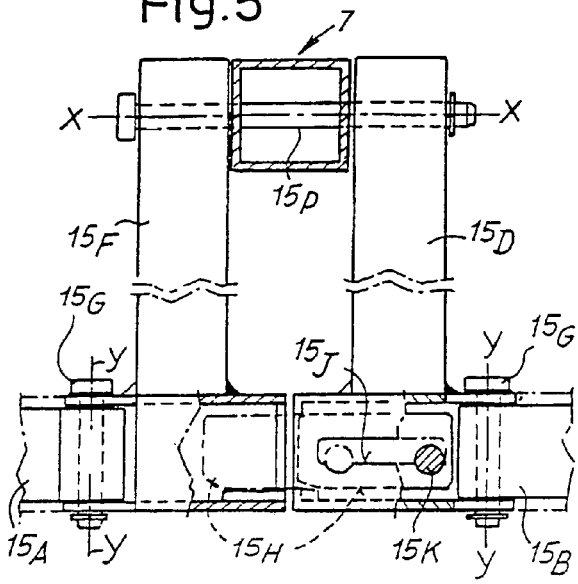
FIG. 5 is a partial view marked V—V in FIG. 1.
Figure 6:
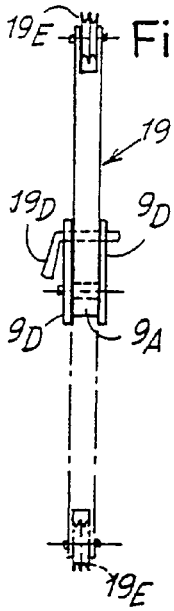
FIG. 6 is a partial view marked VI—VI in FIG. 15.

In front of each bench 9 is a handlebar unit 15 (see also FIGS. 2, 4 and 5) formed by a left and a right handle 15A, 15B which extend generally vertically. The handlebar unit 5 is connected to the bottom end of a pair of rods 15D, 15F hinged to the top bar 7 by a pin 15P. These handles are connected to-the rods 15D, 15F (FIG. 5) by pins 15G having respective axes Y—Y parallel to the axes of the rods 15D, 15F. The bottom ends of the rods 15D, 15F have a transverse cavity through which a sliding bolt 15H can be pushed to lock together the rods 15D, 15F and make them move as one as they pivot about the axis X—X. To enable it to be moved, the sliding bolt 15H has an arm in the form of a projecting pin 15K sliding in a slot 15J formed in the rod 15F. In this way the handles can be locked together and used simultaneously, or else left independent of each other. Each handle can be connected by a cable 15L passing around a sheave 15M to the set of weights, 13 to enable the person sitting in the workstation to lift it by rotating the handlebar unit in the direction F1 about the axis X—X and/or the handles 15A, 15B about their respective axes Y—Y in the direction F2, thereby exercising, muscles in the arms and chest. Stops 7B mounted on the top bar 7 limit the pivoting of the rods 15D, 15F in both directions.

In addition, each bench 9 comprises, hinged about a horizontal axis X1—X1 to the end of the central bar 9A (FIGS. 1 and 4) supporting the horizontal sitting surface, a pivoting rod 19 with, mounted on opposite sides, a pair of rotatable rollers 20 of horizontal axis that each fit into the instep of the person training, as shown in FIG. 1. A second pair of rotatable rollers 22 is mounted on the central bar 9A to provide support underneath the thighs. The pivoting rod 19 is connected by a cable 19A and sheaves 19B, 19C to the set of weights 13, so that the person sitting in the workstation can lift it by turning the rod 19 in the direction F3, thus exercising muscles in the legs and abdomen.

Additionally, for each workstation, levers 21A, 21B hinged to respective pins 22A, 22B (see also FIGS. 2 and 11) mounted on the base 3 can be rotated by the soles of the feet of the seated person in order to raise the set of weights 13 via respective cables 21C and pulleys 21D, 21E, thus exercising the leg muscles.

Figure 12:
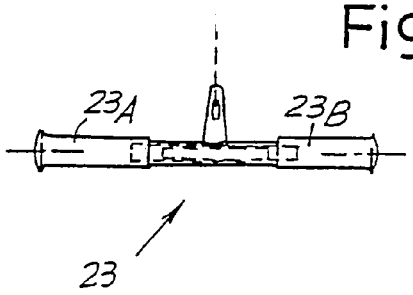
FIGS. 12 and 13 show a partial side view marked XII—XII in FIG. 1 of a handlebar unit, in two different positions of extension.
Figure 13:
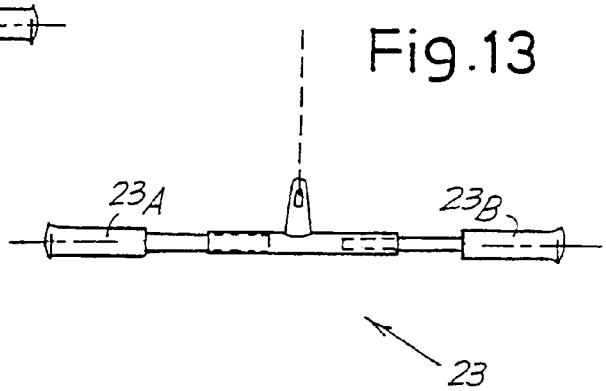

The machine may also include another handlebar unit 23 (see also FIGS. 12 and 13) whose handles 23A, 23B can be moved wider apart for exercising with the arms parallel or spread out as desired. This handlebar unit 23 may be connected to the top bar 7 by a cable 23A passing around pulleys 23B, 23C, allowing the person sitting in the workstation to lift the set of weights 13 by pulling down on the handlebar unit.

The rod 19 can be fixed in a position pointing away from the machine and inclined at an angle of 45° relative to a horizontal plane, using a sliding bolt 19D inserted in holes in the rod 19 and in plates 9D integral with the bar 9A. With the rod 19 locked in this position, the handlebar unit 23 can be used to lift the set of weights 13 by pulling it in the direction F4, as shown in FIG. 15, having first connected the handlebar unit 23 to said set of weights by a cable 23H passing around a pulley 19E mounted on the free end of the rod 19, and around other pulleys such as 23B, 23C fitted to the-top bar 7. This particularly exercises the muscles of the arms and shoulders. Alternatively, after rotating the rod 19 into the vertical upward position shown illustratively in dashes in FIG. 1 and having locked it there by means of the sliding bolt 19D, the handlebar unit 23 can be connected to the set of weights 13 as shown in FIG. 14, via a cable 23W and pulleys 23V, 23Z, in order to be pulled in the direction F5 by a person standing and looking toward the machine, in order to exercise the arms and back in particular. A second cable 23T and pulleys 23R, 23S allow an instructor, using a second handlebar unit 123, to add resistance whenever he wishes to the force of the set of weights 13, for the training of a pupil or of a rehabilitation patient.

Mounted above each workstation, at the ends of the top bar 7, are fans 8 to move the air around the workstations. The drafts of the fans are preferably oriented horizontally so as not to directly strike the people exercising.

The sheaves mentioned in the description, in particular sheaves 21E, 23B, 23C, 19B, 19C, may each have a plurality of adjacent grooves in order to take a plurality of cables simultaneously, for combined exercises.

FIG. 16 shows another embodiment of the invention, with a machine that has four workstations arranged in a radiating pattern in plan view about the vertical axis of symmetry Z—Z of the machine. Each workstation is composed-of components similar to those described in relation to FIG. 1, and there is a set of weights 113 (FIG. 17) in which there are twice as many openings as in FIG. 10 for the passage of the flat rods 12, the openings being situated along the four sides of the plates 113A to enable an orderly arrangement of the connecting cables of the moving parts of each of the four stations with the set of weights 113. In this way up to four people can train together, cooperating to lift the same set of weights 113.

It will be understood that the drawing shows only an example which is provided purely as a practical demonstration of the invention, which invention can be varied in its shapes and arrangements without thereby departing from the scope of the concept on which the invention is based. The presence of any reference numbers in the appended claims is for the purpose of facilitating the reading of the claims with reference to the description, and does not limit the scope of protection represented by the claims.

The invention claimed is:

1. A gymnastic machine for training and/or rehabilitation of the limbs, muscles and joints of the human body, the machine comprising:

a fixed frame to which means are attached that can be actuated by the limbs to overcome a force generated by a resistance component by performing one or more exercises and including at least two identical workstations, each of said workstations for one person, each of said individual workstation including a handlebar unit hinged at the top of the machine by pivoting rods pivoting around a horizontal axis and comprising two handles extending generally vertically and each of said handles hinged to its own one of said pivoting rods about an axis parallel to said rod, said handles of all said workstations being connected to said resistance component so as to allow said persons, working together, to sum their respective efforts as they exercise.

2. Machine according to claim 1, wherein a resistance component shared by said workstations is arranged approximately coaxially with said axis of symmetry.

3. Machine according to claim 1, wherein said pivoting rods can be locked together with a sliding bolt.

4. Machine according to claim 1, wherein the machine further comprises at least two or more workstations arranged symmetrically in a radiating pattern in plan view.

5. A method for training and physical rehabilitation, the method comprising:

providing a gymnastic machine according to claim 1; and exercising by two or more persons, one for each of said workstations, working together using individual identical actuating means belonging to said workstations summing their efforts to overcome said resistance component, such as a set of weights or the like.

6. A gymnastic machine for training and/or rehabilitation of the limbs, muscles and joints of the human body, the machine comprising:

a fixed frame having at least two identical workstations, each of said workstations for one person, each of said identical workstations comprising:

a bench; and arm actuating means for exercising the arms and leg actuating means for exercising the legs, said arm actuating means and said leg actuating means of each individual workstation being connected to a common resistance component so as to allow one person at one workstation and another person at another workstation to sum their respective efforts to overcome the common resistance component.

7. Machine according to claim 6, wherein a resistance component shared by said workstations is arranged approximately coaxially with said axis of symmetry.

8. Machine according to claim 6, wherein said actuating means for each workstation include a bar hinged near the front edge of said bench and a set of support rollers, one for the instep and one for the thighs, said bar being connected to said resistance component by a cable passing over respective sheaves, for exercising the muscles of the legs.

9. Machine according to claim 6, wherein said actuating means for each workstation include a pair of levers that can be actuated with the feet by the person sitting in said workstation, said levers being rotatable about pins fixed to a base of the machine and connected to said resistance component by respective cables passing over pulleys.

10. Machine according to claim 6, wherein said arm actuating means is a handlebar unit hinged at the top of machine by rods pivoting around a horizontal axis, said handlebar unit comprising two handles extending generally vertically and each of said handles hinged to its own one of said pivoting rods about an axis parallel to said rod.

* * * * *